US007394343B2

(12) United States Patent
Cheng et al.

(10) Patent No.: US 7,394,343 B2
(45) Date of Patent: Jul. 1, 2008

(54) BLADE FUSE TESTER HAVING LAMP

(76) Inventors: Wen-Tsung Cheng, No.78 Chao-Chou St., Taoyuan (TW); Wen-Ho Cheng, No.78 Chao-Chou St., Taoyuan (TW)

( * ) Notice: Subject to any disclaimer, the term of this patent is extended or adjusted under 35 U.S.C. 154(b) by 335 days.

(21) Appl. No.: 11/271,908

(22) Filed: Nov. 14, 2005

(65) Prior Publication Data

US 2007/0109090 A1 May 17, 2007

(51) Int. Cl.
*H01H 85/30* (2006.01)
*H01H 85/32* (2006.01)

(52) U.S. Cl. ..... 337/265; 337/266; 324/507; 324/550

(58) Field of Classification Search ..... 337/265, 337/266; 324/507, 550
See application file for complete search history.

(56) References Cited

U.S. PATENT DOCUMENTS 988,891 A * 4/1911 Mitchell ..... 324/550
1,053,770 A 2/1913 Barager
1,109,450 A * 9/1914 Mitchell ..... 324/556
1,249,965 A * 12/1917 Johnson ..... 324/507
1,636,707 A * 7/1927 Robinson et al. ..... 324/550
1,639,889 A * 8/1927 Humm ..... 362/120
1,724,014 A * 8/1929 Garaux ..... 324/550
2,229,927 A * 1/1941 Kamper ..... 324/556
2,794,167 A * 5/1957 Jones, Jr. ..... 324/507
3,813,626 A * 5/1974 Cetola et al. ..... 337/245
3,820,017 A * 6/1974 Reichenbach ..... 324/550
4,107,602 A * 8/1978 Evans ..... 324/550
4,150,330 A * 4/1979 Hudson et al. ..... 324/507
4,314,383 A * 2/1982 Epstein ..... 7/170
4,414,698 A * 11/1983 Epstein ..... 7/170
4,475,283 A * 10/1984 Olson et al. ..... 29/720
4,841,819 A * 6/1989 Williams ..... 81/3.8
5,002,505 A * 3/1991 Jones et al. ..... 439/620.29
D323,300 S * 1/1992 Define, Sr. ..... D10/78
5,311,139 A * 5/1994 Fogal ..... 324/550
5,378,990 A * 1/1995 Terry ..... 324/550
5,446,388 A * 8/1995 Chick ..... 324/550
5,672,964 A * 9/1997 Vinci ..... 324/72.5
5,701,118 A * 12/1997 Hull et al. ..... 340/638
5,797,298 A * 8/1998 Grevel ..... 81/3.8
5,800,043 A * 9/1998 Walkerow ..... 362/119
5,982,266 A * 11/1999 Sanford et al. ..... 337/168
6,144,284 A * 11/2000 Santa Cruz et al. ..... 337/242

(Continued)

FOREIGN PATENT DOCUMENTS

EP 710974 A1 * 5/1996

(Continued)

*Primary Examiner*—Anatoly Vortman

(57) ABSTRACT

A handheld device having a lamp for testing and clipping a blade fuse includes a handle having two probes extended therefrom, a clamp formed on one end of the handle, and an indicator for indicating the condition of the fuse. One of the probes is movably disposed on the handle, thereby allowing the adjustment of separation between two probes. Finally, one side of the handle includes a first lamp, which is disposed parallel to the probes and is electrically connected to the circuit board for illuminating the fuse to be tested. The other side of the handle includes a second lamp, which is disposed parallel to the clamp and is electrically connected to the circuit board for illuminating the fuse to be pulled out.

4 Claims, 5 Drawing Sheets

U.S. PATENT DOCUMENTS

| | | | | |
|---|---|---|---|---|
| 6,448,785 | B1 * | 9/2002 | Rohmer et al. | 324/550 |
| 7,148,698 | B2 * | 12/2006 | Becker et al. | 324/550 |
| 2002/0135349 | A1 * | 9/2002 | Steber et al. | 324/72.5 |
| 2004/0017203 | A1 * | 1/2004 | Becker et al. | 324/507 |
| 2004/0160225 | A1 * | 8/2004 | Kung | 324/447 |
| 2005/0001439 | A1 * | 1/2005 | Lukaszynski et al. | 294/99.2 |

FOREIGN PATENT DOCUMENTS

| | | | | |
|---|---|---|---|---|
| GB | 2124787 | A | * | 2/1984 |
| GB | 2172709 | A | * | 9/1986 |
| JP | 07302537 | A | * | 11/1995 |
| JP | 08315712 | A | * | 11/1996 |
| TW | 154246 | | | 3/1991 |

* cited by examiner

BLADE FUSE TESTER HAVING LAMP

BACKGROUND OF THE INVENTION

The present invention relates generally to a blade fuse tester, and more particularly to a blade fuse tester having a lamp.

Electricity is one of the most important source of power in the daily life of modern people. Electrical device is widely applicable to all aspects of human life. However, the current flowed in the circuitry of the electrical device might occasionally exceed the sustainable limit, which will damage the electrical device or cause a fire. In order to prevent such a danger, a fuse is often used forming a series connection with the circuitry. Therefore, the fuse co-exists with most of the electrical devices. Particularly in the auto industry, fuses are an integral part of automobiles. Most of the fuses of an automobile are collected in a fuse box, which includes a plurality of blades, each blade having a fuse contained therein.

There are currently two types of fuses available in the market. One is the cylindrical fuse, while the other is the blade fuse. The cylindrical fuse includes a narrow cylindrical tube, which includes a fragile metallic wire wrapped therein. The blade fuse is a relatively flat, which includes a pair of male conducting terminal that can be inserted to the female terminal of the fuse box. In the automobile industry, people are more favorable to the blade fuse.

In order to maintain a good electrical connection within a circuitry, fuses are often tightly embedded in a fuse box, which renders it difficult to replace the damaged fuses. In addition, fuse box is often disposed at a location that is hardly accessible, for example, below the dash board, under the engine cover, or oftentimes behind the engine parts. Therefore, a fuse clip is invented and disclosed in the U.S. Pat. No. 1,053,770 for users to easily pick up the damaged blade fuse from the fuse box. Furthermore, a combination of fuse clip and fuse tester is invented and disclosed in Taiwanese Patent No. 154246 allowing users to perform two different tasks with a single tool.

However, the task of testing fuses is often performed under an environment without sufficient light. For this reason, an additional light source is required. Under such a circumstance, the user needs to use one hand to grab a flash light, while using the other hand to hold the fuse tester. Such simple task of testing fuses thus becomes unnecessarily difficult.

BRIEF SUMMARY OF THE INVENTION

The present invention is to provide a fuse tester having a lamp, which is applicable to the examination of blade fuses. The tester includes two probes electrically connected to the circuit board, and a clamp formed at one end thereof. Two lamps are relatively disposed at the front end and the back end of the tester. The front lamp will illuminate on the fuse when performing the fuse testing task, while the back lamp will illuminate the damaged fuse when trying to pull it out. Therefore, no additional flash light is required when the testing task is performed in a dark environment.

Further, since one end of tester of the present invention includes a clamp, one can easily pull out the damaged fuse when one is detected. Meanwhile, the separation between probes is slidingly adjustable, which is structurally simple and easy to manufacture.

The present invention includes many advantages. It not only highly safe and convenient, it is also capable of performing the fuse testing with only a few simple steps. For the manufacturers, the fuse tester of the present invention is structurally simple and easy to assembly, which can largely reduce the manufacturing cost.

In summary, the fuse tester having a lamp for testing and clipping a blade fuse includes a handle having two probes extended therefrom, a clamp formed on one end of the handle, and an indicator for indicating the condition of the fuse. One of the probe is movably disposed on the handle, thereby allowing the adjustment of separation between two probes. Finally, one side of the handle includes a first lamp, which is disposed parallel to the probe and is electrically connected to the circuit board for illuminating the fuse to be tested. The other side of the handle includes a second lamp, which is disposed parallel to the clamp and is electrically connected to the circuit board for illuminating the fuse to be pulled out.

DETAILED DESCRIPTION OF THE INVENTION

In order to better understanding the features and technical contents of the present invention, the present invention is hereinafter described in detail by incorporating with the accompanying drawings. However, the accompanying drawings are only for the convenience of illustration and description, no limitation is intended thereto.

Figure 1:
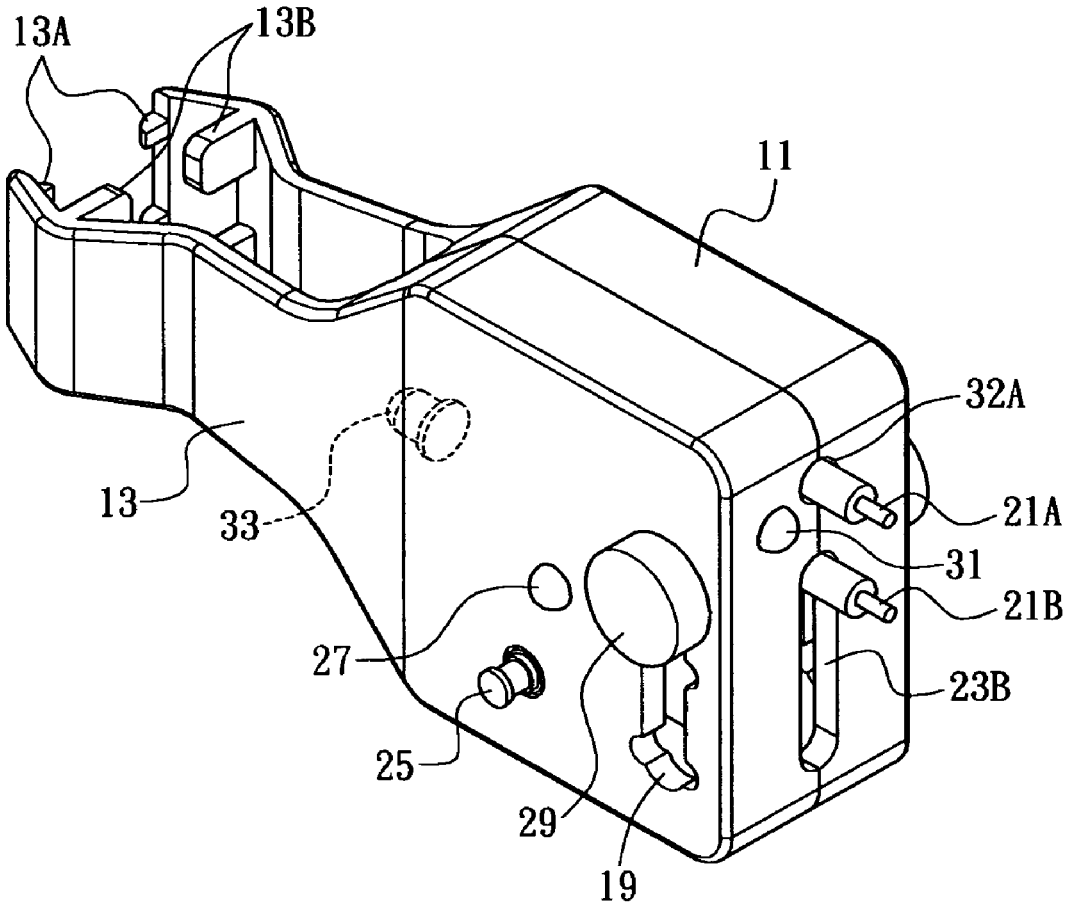
FIG. 1 is a perspective view of a fuse tester of the present invention.

Referring to FIG. 1, a fuse tester of the present invention includes a handle 11, a clamp 13 formed on one end of the handle 11. The clamp 13 includes two hooks 13A formed at the inner sides of the front end of the clamp facing with each other. The clamp 13 also includes a longitudinal obstacle 13B. The clamp 13 is used to pick up the old or damaged fuse, and to hold the new fuse. The hook 13A can grab a fuse in a fuse box and pull the fuse out therefrom. Conversely, the hook 13A can grab a new fuse and insert the new fuse into the fuse box by incorporating with the obstacle 13B.

Referring again to FIG. 1, the first probe 21A is extended from the first probe groove 32A on the other end of the handle 11, and is affixed thereon. The second probe 21B is connected with and controlled by the adjustment knob 29, which is movably disposed in the second probe groove 23B. Since the second probe groove 23B is a linear through groove formed at the front end of the handle 11, the second probe 21B can thus linearly slide along the groove. The second probe 21B is separated with the first probe 21A by a predetermined distance according to the size of the fuse.

According to FIG. 1, an electronic testing circuit board (not shown) is disposed in the handle 11, which is electrically connected to an indication unit 27, such as a light emitting diode (LED) indicator. The LED indicator 27 is exposed outside of the handle 11, so as to allow users to read the testing result. The front end of the circuit board is electrically connected to the two probes 21A, 21B, which are protruded outside of the housing from the probe grooves 32A, 23B of the handle 11.

As shown in FIG. 1, the front end and the back end of the handle 11 include a first lamp 31 and a second lamp 33, respectively. The power switch 25 is used to turn on and off of the lamps 31, 33. The power switch 25 is an electronically controlled switch that has three adjustable sections. The power switch 25 can control the two lamps 31, 33 that they be brighter, dimmer or completely off. The user is then free to choose the brightness of the lamps 31, 33 for different working environments. In this particular embodiment, the lamps 31, 33 are light emitting diodes, which are more economic in power consumption.

Figure 2:
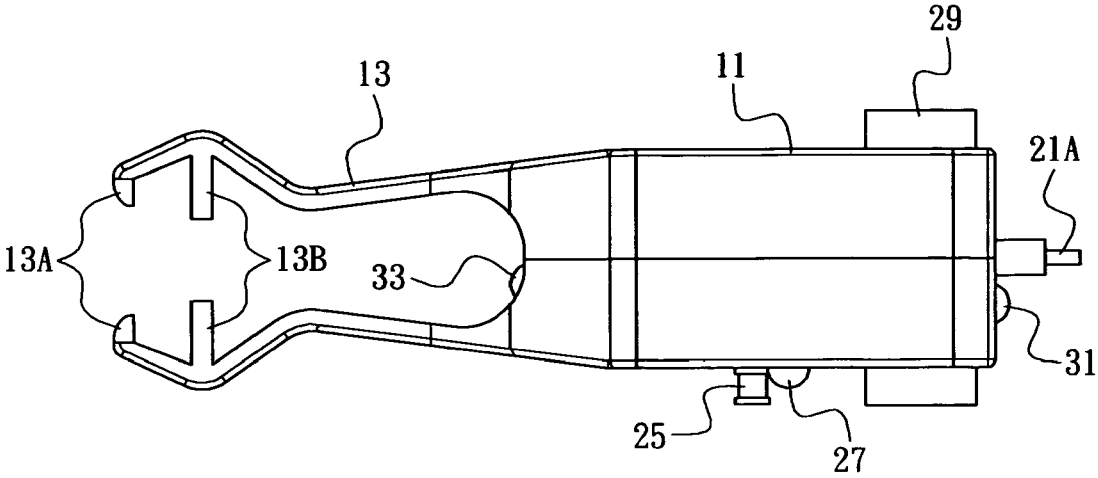
FIG. 2 is a side view of the fuse tester of the present invention.

Referring to FIG. 2, a side view of the fuse tester of the present invention is illustrated. As shown, the fuse tester of the present invention includes a clamp 13 formed on one end thereof The clamp 13 includes pair of deformed bodies facing with each other. A hook 13A and a longitudinal obstacle 13B are formed at the front end of each deformed body. In addition, a lamp 31, 33 is disposed on the front end and the back end of the handle 11, respectively. Therefore, the first lamp 31 is used when the probes are testing fuses, while the second lamp 33 is used when the clamp 13 is removing or installing fuses.

Figure 3:
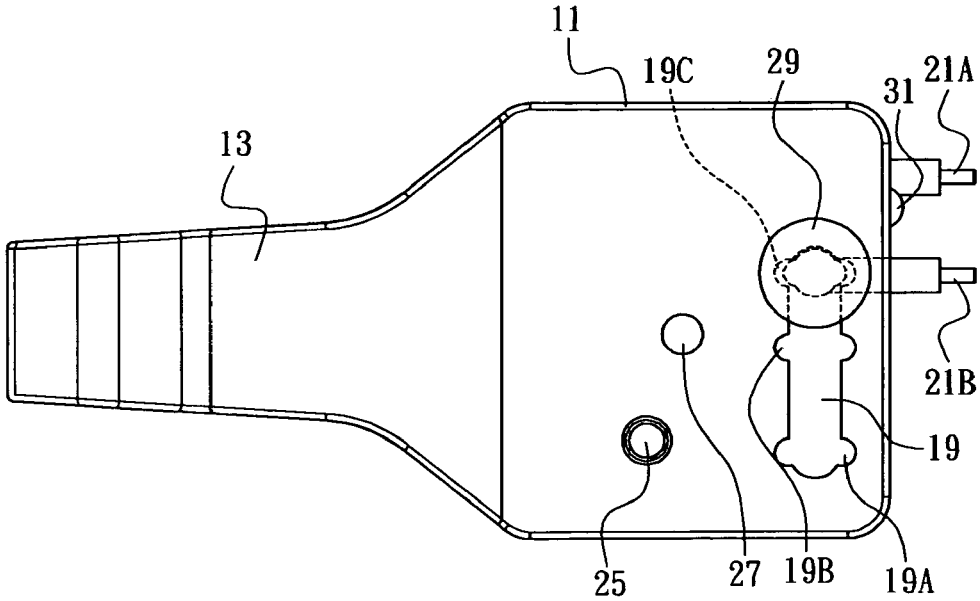
FIG. 3 is a top view of the fuse tester of the present invention.

Referring to FIG. 3, a top view of the fuse tester of the present invention is illustrated. As shown, the second probe 21B is controlled by the adjustment knob 29 formed on the handle 11 perpendicular to the second probe 21B. The adjustment knob 29 can linearly slide in the sliding groove 19, thereby moving the second probe 21B together therewith. As shown, the sliding groove 19 is formed on the handle 11 as a linear hole. Meanwhile, wider notches 19A, 19B and 19C are formed on the sliding groove 19. The adjustment knob 29 can then temporarily lock to one of the notches 19A, 19B or 19C while moving along the sliding groove 19. That is, the position of the second probe 21B can be locked in three different sections. Any person having ordinary skills in the art shall appreciate that the sliding groove having any number of notches is considered within the scope of the present invention.

Figure 4:
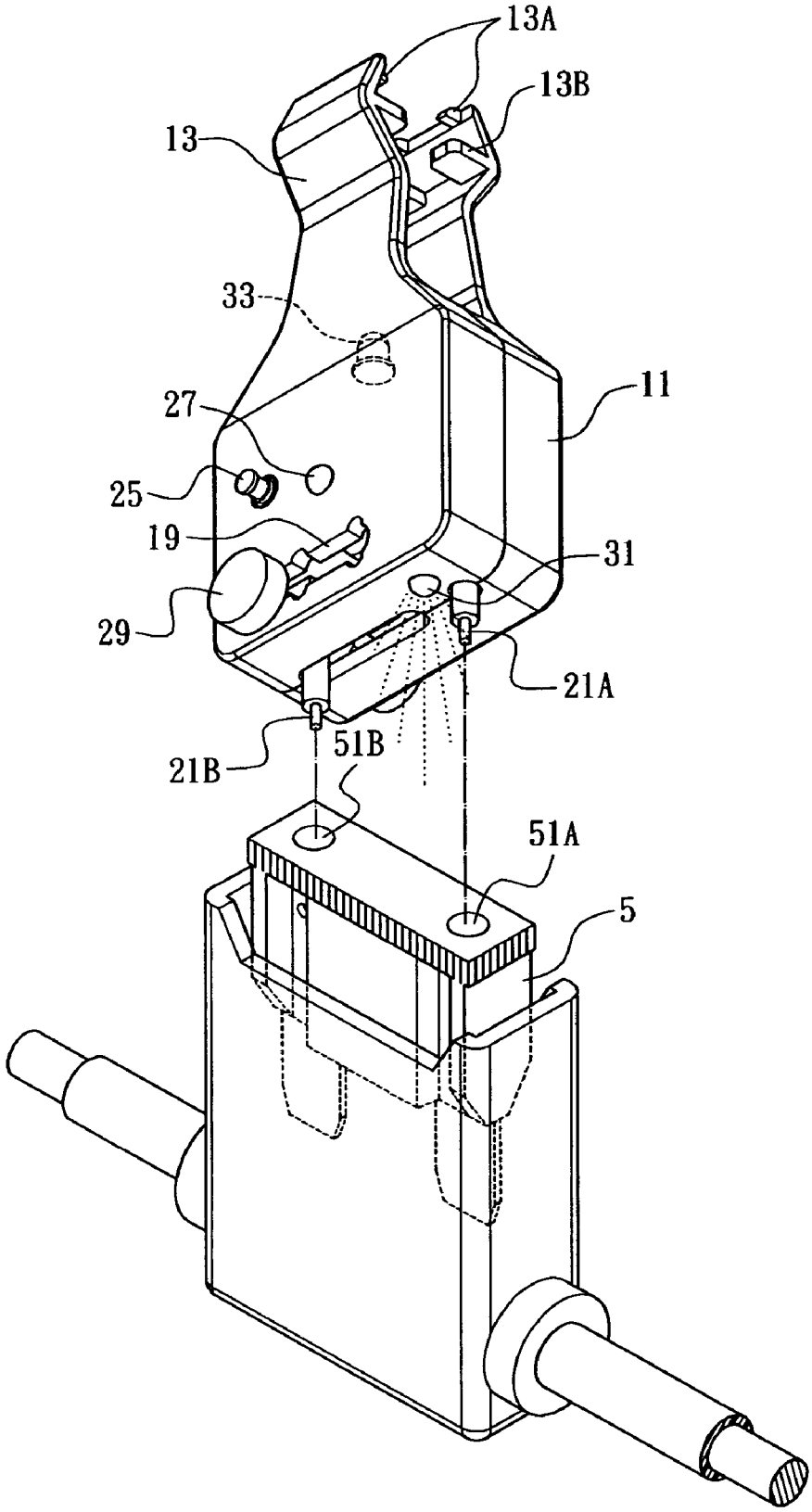
FIG. 4 is a perspective view illustrating a fuse being tested by the fuse tester of the present invention.
Figure 5:
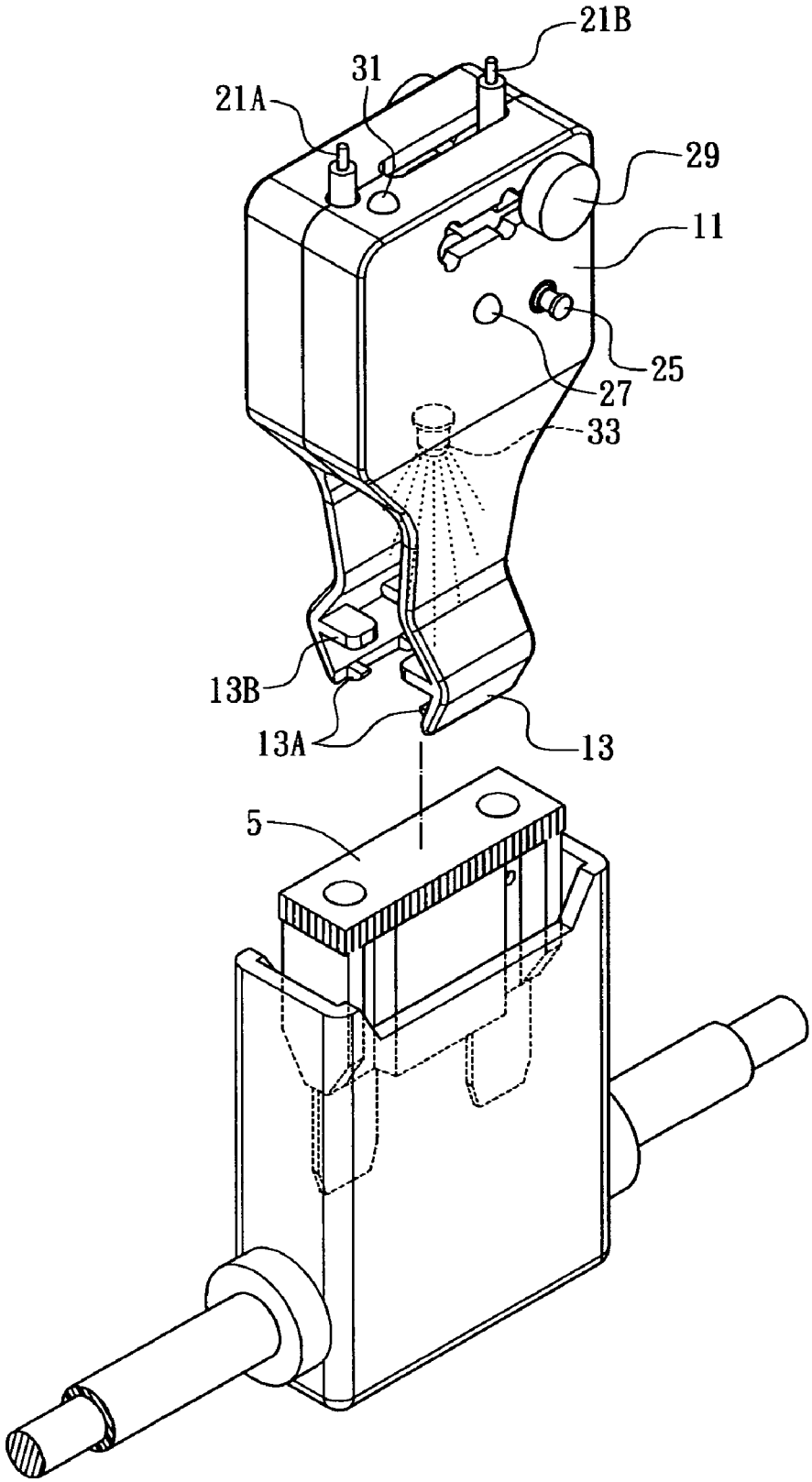
FIG. 5 is a perspective view illustrating a fuse being clipped by the fuse tester of the present invention.

FIG. 4 and FIG. 5 illustrates that the fuse tester is testing the fuse. The fuse (not shown) is disposed in the blade fuse 5. Two electrodes 51A, 51B are formed on the blade fuse 5. When performing the test, the adjustment knob 29 is locked in a notch, thereby making the separation of probes 21A, 21B being the same as that of the electrodes 51A, 51B. In this particular embodiment, the adjustment knob is affixed to notch 19A, making the separation of the probes being the largest. In addition, as shown in FIG. 4, the first probe 21A contacts the first electrode 51A, while the second probe 21B contacts the second electrode 51B, thereby electrically connecting the two probes and the fuse to be tested. The LED lamp 27 is used to determine whether the fuse is damaged or not. The user can press the power switch 25 to turn on the first lamp 31. The illuminated light can enhance the performance of fuse testing.

On the other hand, as shown in FIG. 5, when the damaged fuse is found, one can immediately invert the fuse tester of the present invention, so as to use the hook 13A to clip on the blade fuse 5. The blade fuse 5 is then fastened between the obstacle 13B and the hook 13A. One can thus easily pull out the damaged blade fuse 5. Similarly, a new blade fuse is installed back to the original position following the reverse procedure. The user can again press the power switch to turn off the first lamp 31 and turn on the second lamp 33, so as to aid the removal procedure.

It is noted that the first lamp 33 of the present invention is preferably along the same direction as that of the probes. Therefore, the first lamp 33 can also be disposed to any position parallel to the probes. Similarly, the second lamp 33 is used to as an auxiliary part of the clamp 13, it can also be disposed to any position parallel to that of the clamp 13.

Figure 6:
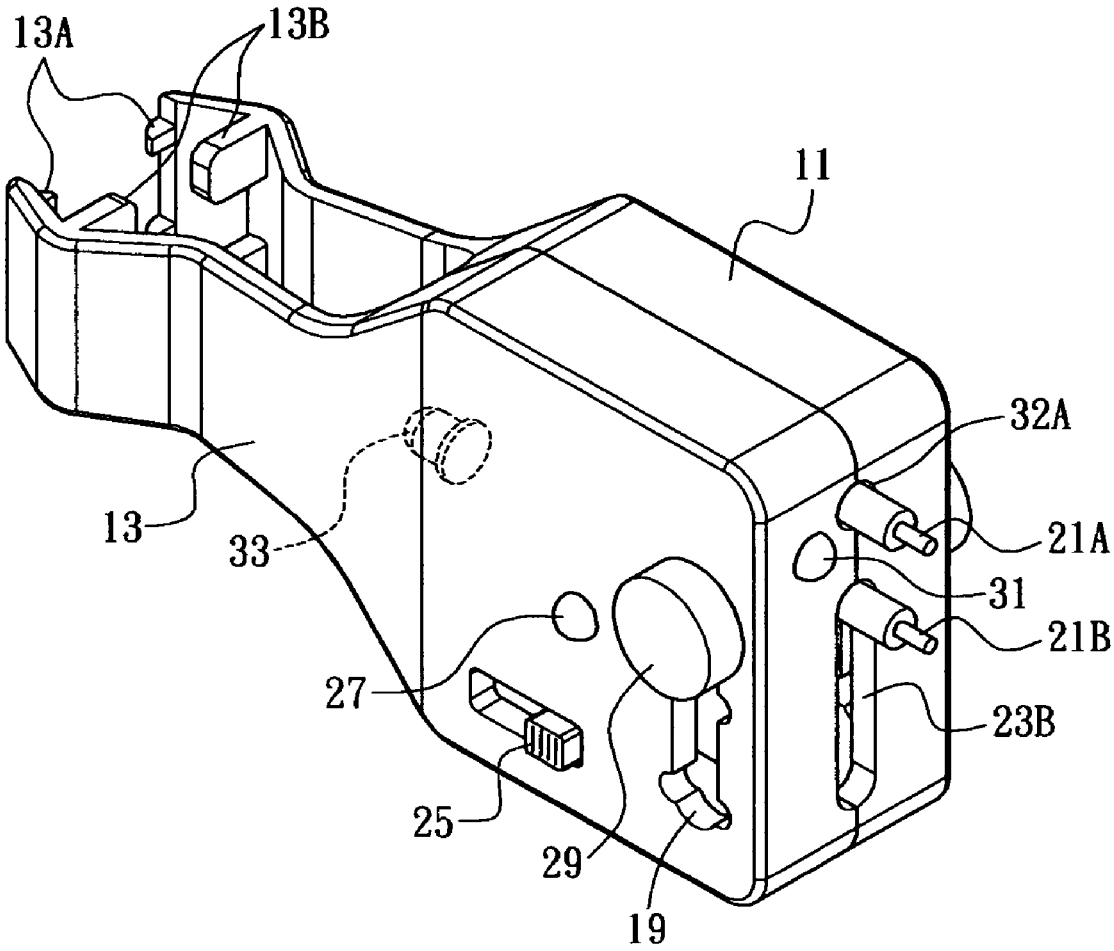
FIG. 6 is a perspective view of the fuse tester, in accordance with another embodiment of the present invention.

FIG. 6 illustrates a fuse tester in accordance with another aspect of the present invention. As shown, the power switch 25 includes a mechanical switch having three sectional controls. The three sectional controls includes 1) turning off, 2) turning on the first lamp, and 3) turning on the second lamp. Therefore, the user can choose to turn on the first lamp, to turn on the second lamp, or to turn off both lamps.

Since, any person having ordinary skill in the art may readily find various equivalent alterations or modifications in light of the features as disclosed above, it is appreciated that the scope of the present invention is defined in the following claims. Therefore, all such equivalent alterations or modifications without departing from the subject matter as set forth in the following claims is considered within the spirit and scope of the present invention.

What is claimed is:

1. A handheld device for testing a blade fuse, comprising a handle having a clamp formed on one end thereof, the handle comprising two probes extended out from the handle, and an indication unit exposed outside of the handle for indicating whether the tested fuse is damaged; wherein one side of the handle comprises a first lamp, which is disposed parallel to the probes for illuminating the fuse to be tested;

another side of the handle comprises a second lamp, which is disposed parallel to the parallel to the clamp for illuminating the fuse to be pulled out;

a linear sliding groove is formed on the handle;

a plurality of wider notches formed on the sliding groove; and an adjustment knob is formed on the handle, the adjustment knob can linearly slide in the linear sliding groove to move one of the probes together therewith and can be temporarily locked in each of the wider notches and thereby allowing the adjustment of separation between the two probes.

2. The device as recited in claim 1, further comprising a switch being an electronic switch to turn on and off of the first and second lamps.

3. The device as recited in claim 1, further comprising a switch being a mechanical switch to turn on and off of the first and second lamps.

4. The device as recited in claim 1, wherein the first and second lamps are light emitting diodes.

* * * * *